US008408985B2

(12) United States Patent
Sestak et al.

(10) Patent No.: US 8,408,985 B2
(45) Date of Patent: Apr. 2, 2013

(54) PROVIDING MULTIPLE HANDS OF AN ONLINE GAME IN A SINGLE TABLE ENVIRONMENT

(75) Inventors: Karl Thomas Sestak, Weldon Spring, MO (US); Joseph Michael Galloway, Saint Charles, MO (US)

(73) Assignee: DP3 Consulting, LLC, Clayton, MO (US)

( * ) Notice: Subject to any disclaimer, the term of this patent is extended or adjusted under 35 U.S.C. 154(b) by 5 days.

(21) Appl. No.: 12/889,175

(22) Filed: Sep. 23, 2010

(65) Prior Publication Data

US 2012/0077559 A1 Mar. 29, 2012

(51) Int. Cl.
*A63F 9/24* (2006.01)

(52) U.S. Cl. ..... 463/13; 463/12; 463/15; 463/40

(58) Field of Classification Search ..... None
See application file for complete search history.

(56) References Cited

U.S. PATENT DOCUMENTS

| | | | | |
|---|---|---|---|---|
| 5,800,268 | A * | 9/1998 | Molnick | 463/40 |
| 6,142,872 | A | 11/2000 | Walker et al. | |
| 6,361,441 | B1 | 3/2002 | Walker et al. | |
| 6,712,699 | B2 | 3/2004 | Walker et al. | |
| 7,364,510 | B2 | 4/2008 | Walker et al. | |
| 7,558,599 | B2 | 7/2009 | Silverbrook et al. | |
| 7,637,811 | B2 | 12/2009 | Walker et al. | |
| 8,047,909 | B2 | 11/2011 | Walker et al. | |
| 2004/0132521 | A1 * | 7/2004 | Peterson | 463/16 |
| 2004/0242303 | A1 | 12/2004 | Walker et al. | |
| 2006/0247013 | A1 | 11/2006 | Walker et al. | |
| 2006/0247014 | A1 | 11/2006 | Walker et al. | |
| 2007/0010321 | A1 | 1/2007 | Walker et al. | |
| 2007/0010322 | A1 | 1/2007 | Walker et al. | |
| 2007/0015571 | A1 | 1/2007 | Walker et al. | |
| 2007/0077985 | A1 | 4/2007 | Walker et al. | |
| 2007/0087823 | A1 | 4/2007 | Walker et al. | |
| 2007/0093288 | A1 | 4/2007 | Walker et al. | |
| 2007/0129141 | A1 | 6/2007 | Walker et al. | |
| 2007/0129149 | A1 | 6/2007 | Walker et al. | |
| 2007/0149278 | A1 | 6/2007 | Walker et al. | |
| 2007/0155460 | A1 | 7/2007 | Burnside et al. | |
| 2010/0216534 | A1 * | 8/2010 | Peck et al. | 463/13 |
| 2011/0039610 | A1 * | 2/2011 | Baerlocher et al. | 463/12 |
| 2012/0046111 | A1 | 2/2012 | Walker et al. | |
| 2012/0270623 | A1 | 10/2012 | Walker et al. | |
| 2012/0270646 | A1 | 10/2012 | Walker et al. | |
| 2012/0270660 | A1 | 10/2012 | Walker et al. | |

FOREIGN PATENT DOCUMENTS

WO WO 2005/094347 10/2005

* cited by examiner

*Primary Examiner* — Paul A D'Agostino
(74) *Attorney, Agent, or Firm* — Harness, Dickey & Pierce, P.L.C.

(57) ABSTRACT

A system for providing game play. The system includes processors and memory configured to include users as players at a table in an online game and provide cards to the players for playing a first hand of the game. When a jump point is reached in the first hand, the following are provided to at least the players no longer playing the first hand: cards for playing a second hand at the table, and continued online access to play of the first hand. Strategic aspects of face-to-face poker play are retained while action-seeking players can see more hands per hour.

20 Claims, 8 Drawing Sheets

PROVIDING MULTIPLE HANDS OF AN ONLINE GAME IN A SINGLE TABLE ENVIRONMENT

FIELD

The present disclosure relates to online gaming, for example, online play of card games such as poker.

BACKGROUND

This section provides background information related to the present disclosure which is not necessarily prior art. The Internet provides opportunities for people in various geographical locations to play games with one another in an online environment. Although the game of poker has been described as providing hours of boredom and seconds of exhilaration, websites providing online poker play have become highly popular. In conventional online poker, hands typically are played in a sequential fashion, where the players at a table are required to finish the current hand before the next hand can be dealt. This can result in a considerable amount of waiting time for those players who were in the current hand but opted out of play (i.e., folded) in that hand.

SUMMARY

This section provides a general summary of the disclosure, and is not a comprehensive disclosure of its full scope or all of its features.

The present disclosure, in one implementation, is directed to a system for providing game play. The system includes one or more processors and memory configured to include a plurality of users as players at a table in an online game and provide cards to the players for playing a first hand of the game. When a jump point is reached in the first hand, the following are provided to at least the players no longer playing the first hand: cards for playing a second hand at the table, and continued online access to play of the first hand.

In another implementation, the disclosure is directed to a method of providing game play. The method is performed by one or more processors using memory. The method includes receiving inputs from a plurality of users by which the users choose to play an online game, and in response to the inputs, including the users as players at an online table. Cards are provided to the players for playing a first hand of the game. When a jump point in the first hand is reached, cards for playing a second hand at the table are provided to at least the players no longer playing the first hand. The method also includes continuing to provide online access by players of the second hand to play of the first hand.

In yet another implementation, the disclosure is directed to a system for providing game play. The system includes one or more processors and memory configured to, via a network, include a plurality of users as players at a table in an online game. Cards are provided to the players for playing a first hand of the game. The processor(s) and memory are configured to monitor at least a number of players still playing in the first hand, and based on the monitoring, determine whether a jump point is reached in the first hand. Based on the determining, the system may provide the following to at least the players no longer playing the first hand: cards for playing a second hand at the table, and continued online access to play of the first hand.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. Although various implementations of the disclosure are described with reference to games of Internet poker, the disclosure is not so limited. Implementations may be directed to other online games in which hands of cards are played. Additionally or alternatively, the disclosure may be implemented in relation to other or additional online environments, including but not limited to other or additional internets, intranets and/or computing environments.

It has been observed that people who play poker and other games frequently enjoy playing at a table with the same opponents over multiple hands of a game. In this way the players can come to understand their opponents' betting and playing habits. Poker games can tend to be battled, after several rounds of betting and examination of hands, by two or three players "seeing all streets" and having a "showdown." Meanwhile, however, the players who have "folded" their cards typically must sit and wait for a hand to complete. This can be a boring wait.

Figure 1:
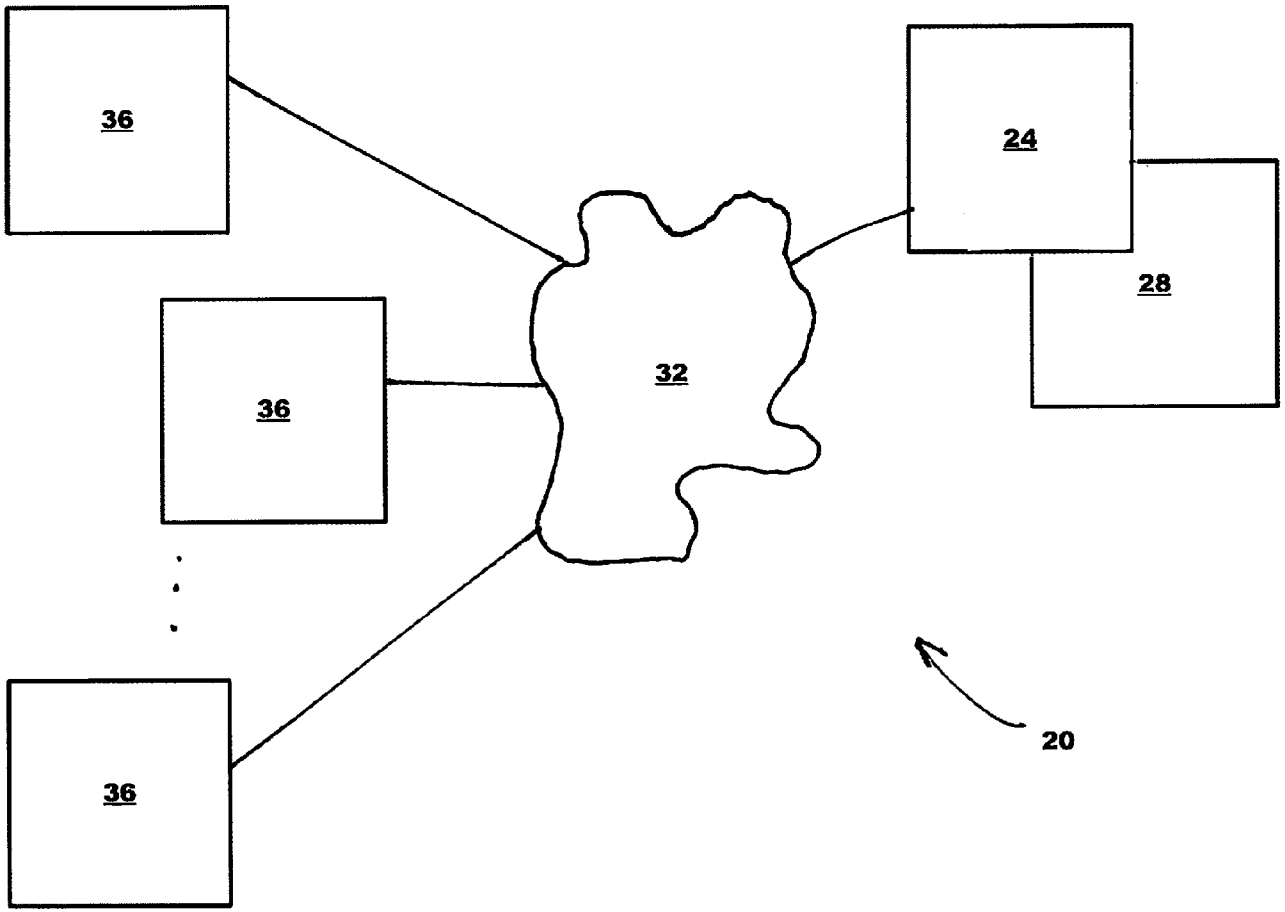
FIG. 1 is a diagram of a system for providing game play in accordance with one implementation of the disclosure.

One embodiment of a system for providing game play is indicated generally in FIG. 1 by reference number 20. The system 20 includes one or more processors 24 configured with one or more memories 28. A single processor 24 and memory 28 are shown in FIG. 1. The processor 24 is capable of communicating via the Internet 32 with a plurality of user devices 36, e.g., personal computers of a plurality of users of the system 20. It should be noted generally that various types of processors, memory and/or networking elements could be used, including but not limited to various computers, servers, routers, storage devices, computer-based phones, computer tablets, etc. Those knowledgeable in the art will appreciate that many devices and combinations thereof are possible in various embodiments of the disclosure.

Figure 2A:
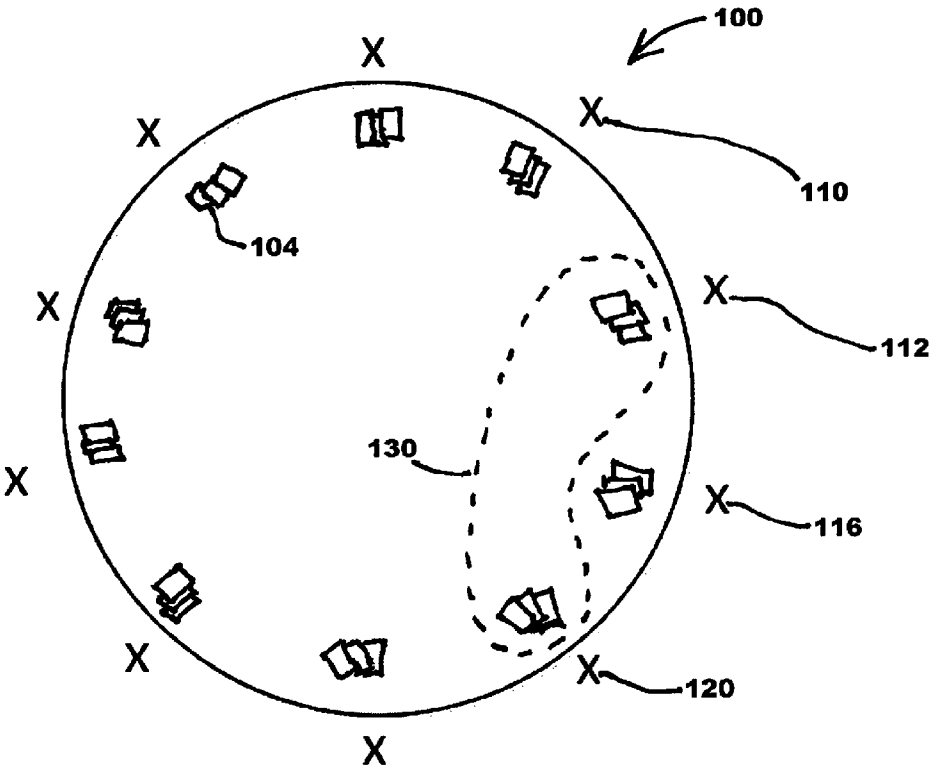
FIG. 2A is a diagram of an online table in accordance with one implementation of the disclosure.

In one implementation shown conceptually in FIG. 2A, the processor 24 and memory 28 are configured to include the users of the devices 36 as players at a table 100 in an online game and to provide cards 104 to the players for playing a first hand of the game. It should be understood that the number of cards 104 shown in FIG. 2A is for illustrative purposes only, and that various games may entail the dealing and/or play of various numbers of cards. When a jump point is reached in the first hand as further described below, the system 20 provides, to at least the players no longer playing the first hand, cards 104 for playing a second hand at the table 100, and also provides continued online access, by the players no longer playing the first hand, to view the play of the first hand.

Generally, a jump point happens in the course of a game when a set of predefined criteria are met to cause the play of a hand at a table to change into play of more than one hand at the table. Criteria for reaching a jump point can be predefined in various ways depending at least in part on the type of game being played. For a given game, logic for predefining and determining the occurrence of one or more jump points may be stored in the system 20 for reference by the processor 24 during play of that game. In some implementations, a jump point may be determined to have been reached when a number of players playing the first hand has decreased to a predetermined plural number. Additionally or alternatively, a jump point may be determined to have been reached when a predetermined number of players playing the first hand have committed to play (in other words, these players have not folded) in the first hand. Another possible jump point may be defined as occurring when all remaining players in the first hand have committed to play in that hand. Jump points may be triggered, for example, by players calling, checking and/or raising bets. Other possible jump points may determined at set points in a hand, e.g., when flop cards and/or turn cards and/or river cards have been dealt, at which point any player who had folded would be dealt into the second (next) hand. It should be noted that the possible criteria for defining and/or reaching jump points are many and varied.

By providing a player with at least partly concurrent hands within the same online table 100 environment, the system 20 can increase the time during which that player actively plays a game. For example, with reference to FIG. 2A, when players who have folded are waiting on other players to complete a hand, more cards 104 can be dealt to the players who have folded, who can continue to compete in another hand, e.g., instead of being bystanders. Where, e.g., a game at the table 100 is a ten-handed ring game, the following actions might take place. A seat 110 is a small blind seat, a seat 112 is the large blind seat, and action of interest begins at a seat 116. In the present example, the player at seat 116 folds, the player at a seat 120 raises the bet to four times the large blind, and the rest of the players at the table 100 fold around to the player at the seat 112 who calls the action. At this point, if this were a conventional game, eight players would have to wait until the two remaining players at seats 112 and 120 have completed the pot. In the present example, however, in various implementations of the disclosure a "jump point" has been reached. The two remaining players at seats 112 and 120 are included, e.g., in a sub-table 130 at which all ten players can observe the play, and at least the eight "folded" players are dealt a new hand of cards. Thus the action of the game may continue, regardless of various choices made by the players.

Figure 2B:
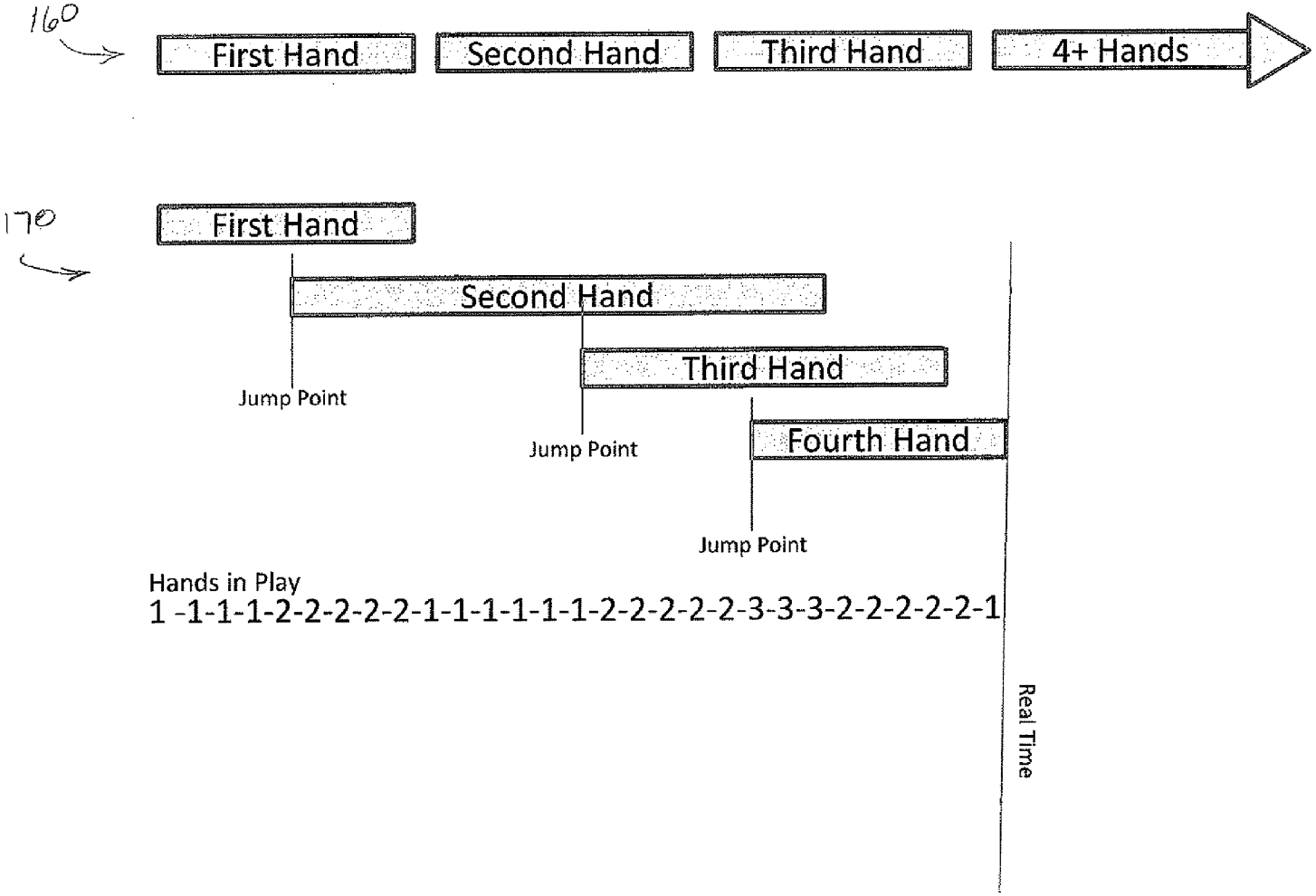
FIG. 2B is a sequence diagram in which sequential hands of a game are compared with partially concurrent hands in accordance with one implementation of the disclosure.

Generally, users may individually and initially select and set options to (a) continue playing a hand at a "sub-table" of the table 100 and/or (b) play a new hand at the table 100 (which may be referred to in the disclosure and claims as the "main table" 100). There could be virtually any number of sub-tables active at any particular time. There also could be virtually any number of players at a sub-table, depending on the type of game and on the type of jump point that prompted the sub-table play. FIG. 2B illustrates a comparison of hands played sequentially in a conventional game and partially concurrent hands played in accordance with one implementation of the disclosure. Sequentially played hands 160 take longer to play in real time compared to hands 170 played partially concurrently.

Figure 3A:
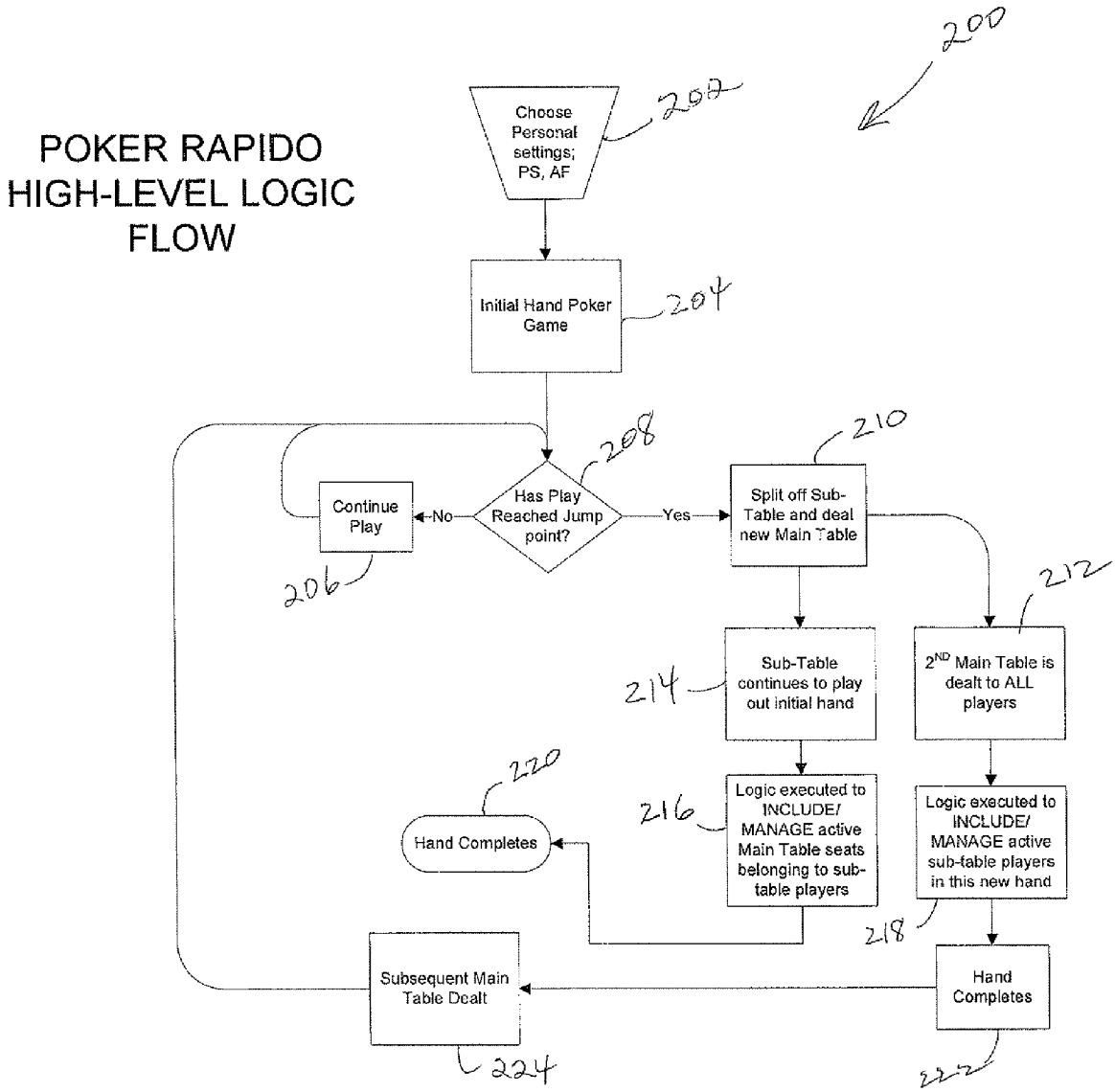
FIGS. 3A through 3E are a flow diagram of a method of providing game play in accordance with one implementation of the disclosure.

A flow diagram of one implementation of a method of providing game play is indicated generally in FIGS. 3A through 3E by reference number 200. The method 200 may be performed, e.g., by the system 20. An example of a high-level logic flow is shown in FIG. 3A. In a process 202 a user of the system 20 selects personal settings for game play. For example, a user may select a play style ("PS") setting and/or an auto fund ("AF") setting. A PS setting determines whether a player wishes to be dealt into a new hand as he/she is still playing a hand at a sub-table of the main table 100. If the PS setting is "Linear", the player finishes the hand at the sub-table before playing in the new hand at the main table 100 (assuming that play in the new hand has not passed that player's position in the new hand.) If the PS setting is "Parallel", a player in a hand at a sub-table will also be dealt cards in a current hand at the main table 100, and the player may play both hands. If an AF setting for a player is "Yes," that player's position in a hand at the main table 100 is protected if that player is still playing a hand at a sub-table. In such case the system 20 makes a deduction from the player's account to cover current play at the main table 100, if necessary. The player typically is required to have enough funds in his/her online account to cover play.

Referring again to FIG. 3A, in a process 204 the system 20 deals cards to the players for a first hand of a poker game at the main table 100. Play continues in a process 206 until it is determined in a process 208 that a jump point has been reached. In a process 210 a sub-table is created for players still playing in the first hand. In a process 212 a new main table (e.g., "second") hand is dealt to all players in the game, including those playing at the sub-table. In a process 214 players at the sub-table continue to play out the first hand. The system 20 performs management functions as to players' active seats at both a sub-table and the main table 100. For example, as sub-table play of the first hand proceeds, in process 216 the system 20 manages active seats at the main table 100 belonging to players at the sub-table. As play of the second hand proceeds at the main table 100, in process 218 the system 20 performs management functions as to players at the sub-table who are also active players in the second hand at the main table 100. Play of the first hand completes in a process 220. Play of the second hand at the main table completes in a process 222, after which a subsequent main table (e.g., "third") hand is dealt in a process 224. If a jump point is not reached in the third hand in the process 208, then play of the third hand continues in the process 206.

Figure 3B:
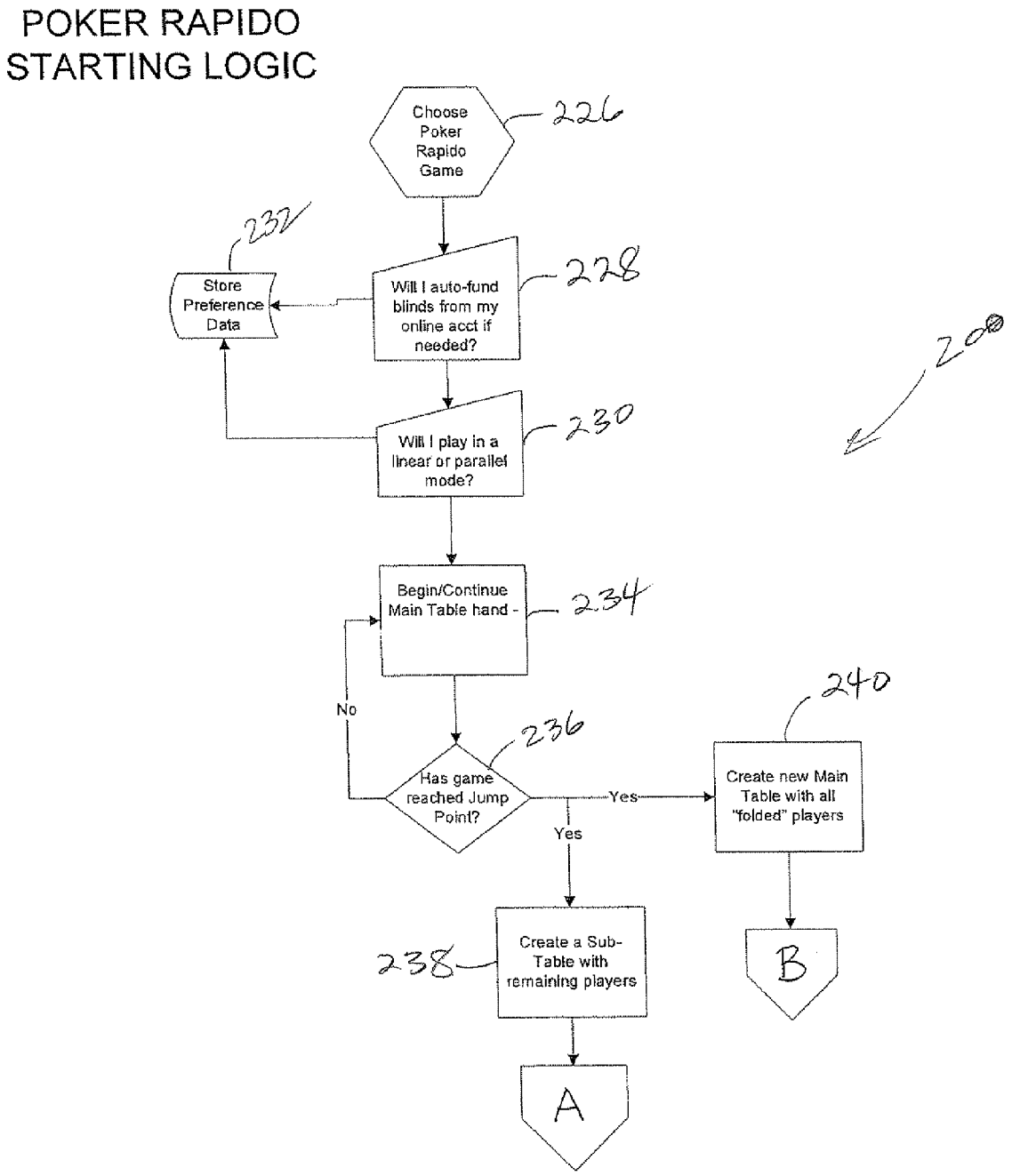

An example of a starting logic flow is shown in FIG. 3B. In a process 226 a user chooses to play a game in accordance with various aspects of the disclosure. In a process 228 the user selects an option as to whether to auto-fund blinds from his/her online account if needed, as previously discussed with reference to FIG. 3A. In a process 230 the user selects a play style, e.g., whether to play in a Linear or Parallel mode as previously discussed. In a process 232 the system 20 stores the user's preference data, e.g., in memory 28. In a process 234 the user plays a hand, e.g., of ten-handed Texas Hold'em at the main table 100. Play continues until it is determined in a process 236 that a jump point has been reached. For example, a jump point may have been reached when two to four players at the main table 100 have, at a minimum, called the last bet. When it is determined that a jump point has been reached, in process 238 a sub-table is created that includes the players remaining in the main table hand. Sub-table logic is performed as further described below with reference to FIG.

3C. Additionally, in process 240 it is arranged for all "folded" players at the main table 100 to play a new main table hand. Main table logic is performed as further described below with reference to FIG. 3D.

Figure 3C:
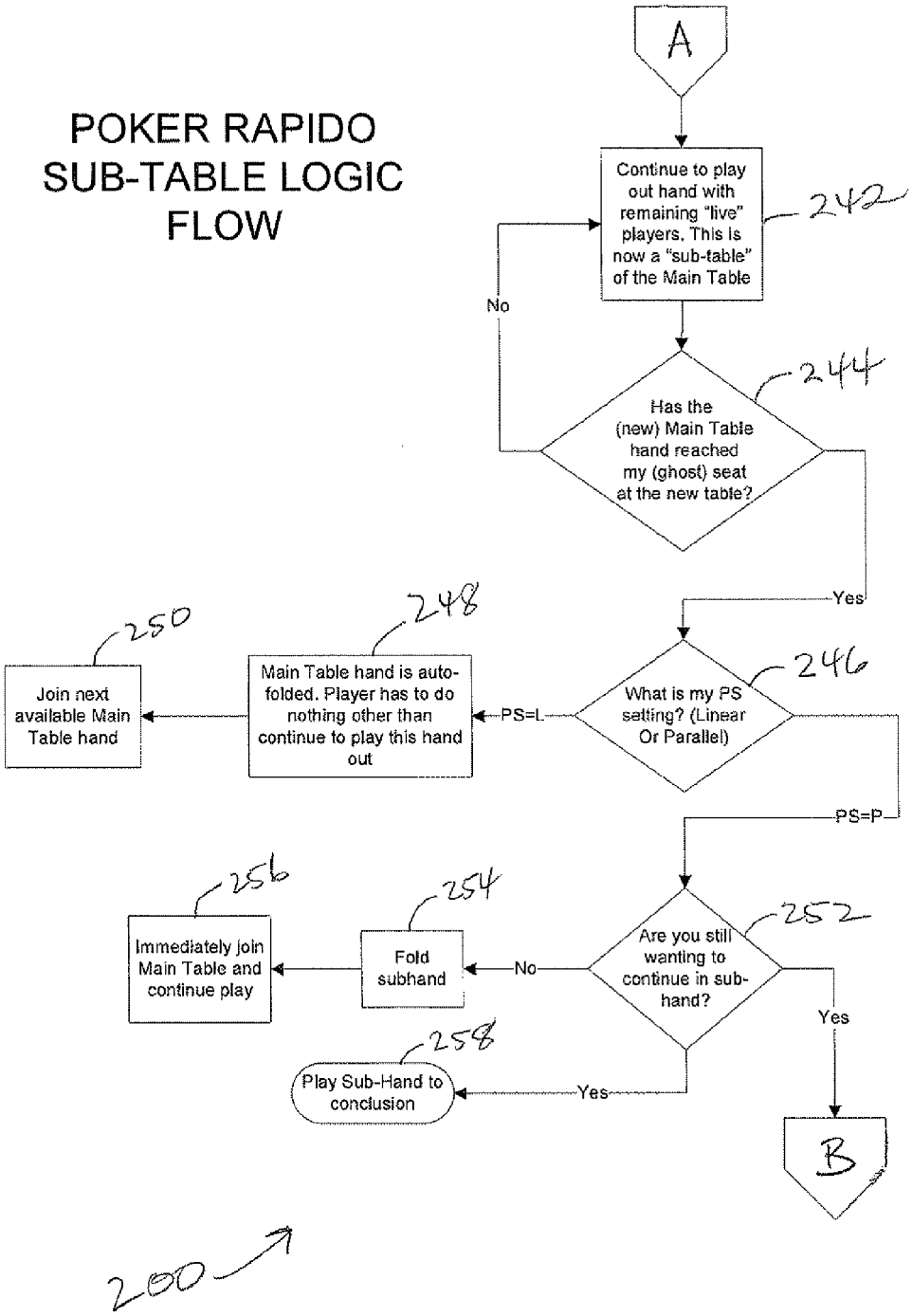

Referring to FIG. 3C, play at the sub-table is continued in process 242 by the remaining players of the previous main table hand. In process 244 it is determined whether, for a given player at the sub-table, that player's seat at the main table 100 has been reached in play of the current main table hand. If yes, then in process 246 it is determined whether the player is playing in Linear or Parallel mode. If it is determined that the player is playing in Linear mode, then in process 248 the player's current main table hand is folded by the system 20, and the player plays the sub-table hand to completion. In process 250 the player may join the next available hand at the main table 100. If in process 246 it is determined that the given player is playing in Parallel mode, it is determined in process 252 whether the player wishes to continue playing the hand at the sub-table. If not, then in process 254 the player's hand at the sub-table is folded, and in process 256 the player may join the play of the current main table hand. If it is determined in process 252 that the player wishes to continue playing the hand at the sub-table, then in process 258 the player plays the hand at the sub-table to conclusion and also may play the current hand at the main table 100.

Figure 3D:
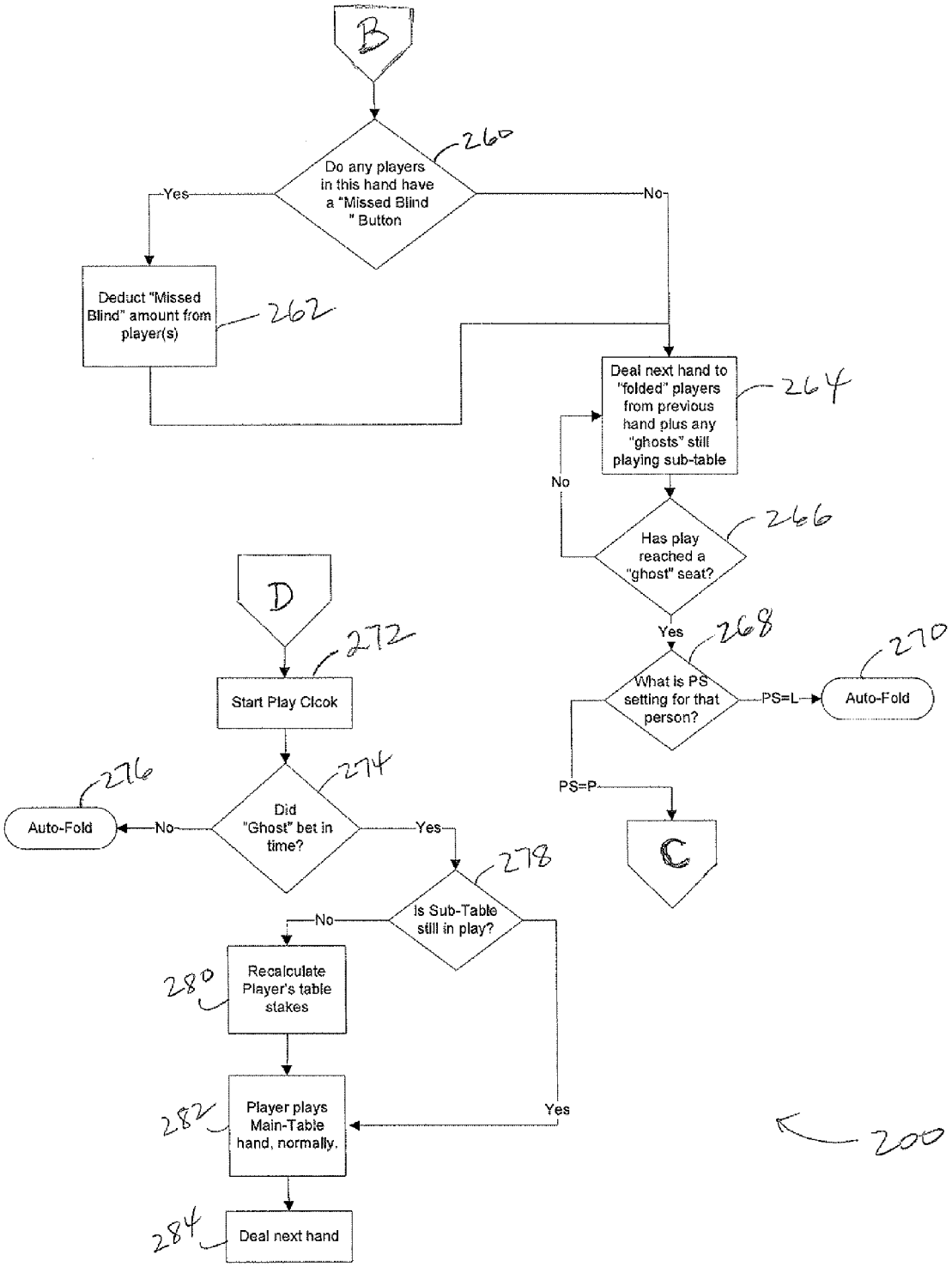
Figure 3E:
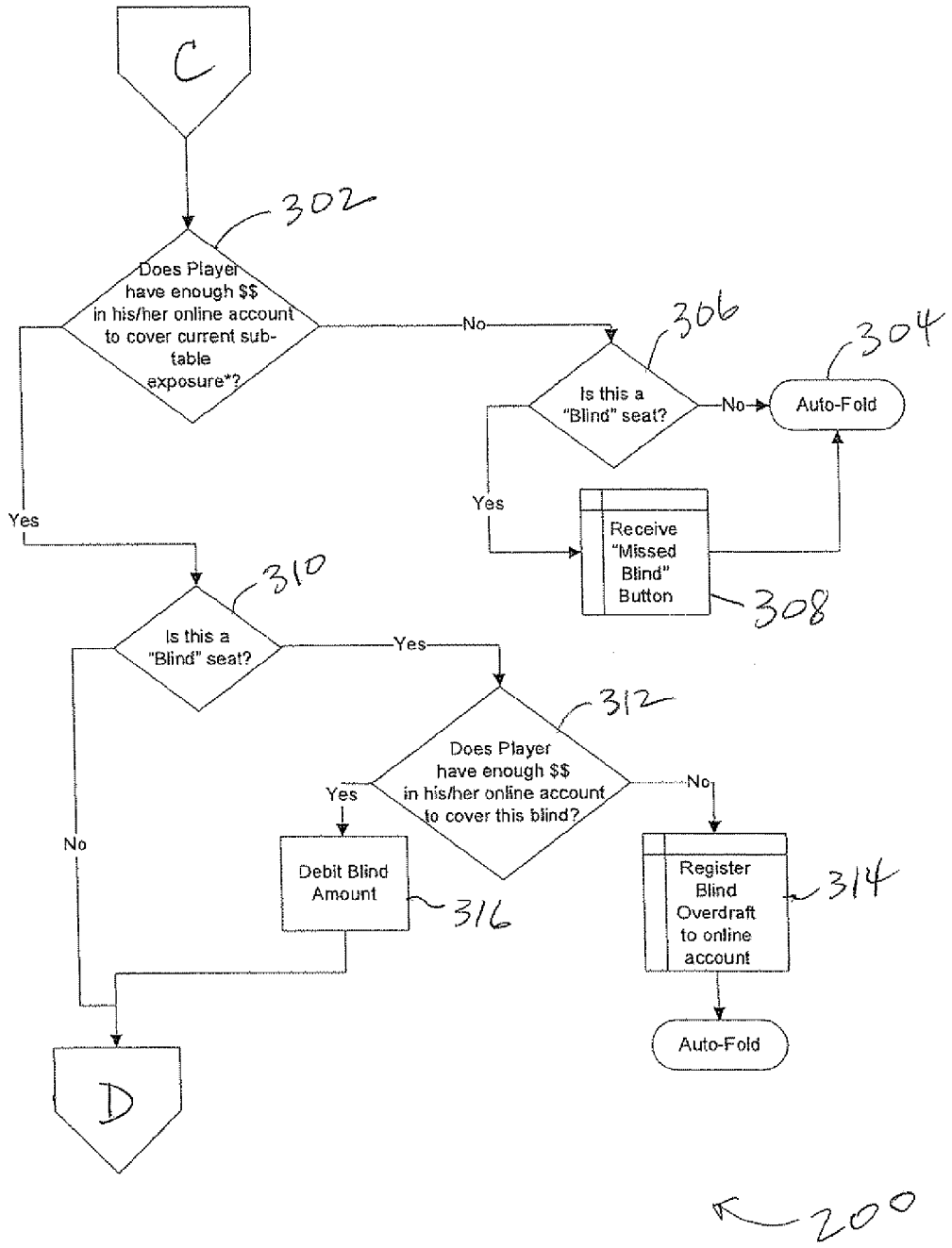

Main table logic is performed as shown in FIG. 3D. In process 260 it is determined whether any players in the current hand at the main table have a "Missed Blind" button. If yes, then in process 262 the system 20 deducts a "Missed Blind" amount from each player who has been determined to have missed paying a blind. In process 264 a new hand is dealt to "folded" players from the main table hand and also to any "ghost" players still playing at the sub-table. In process 266 it is determined whether play at the main table has reached a "ghost" seat, e.g., of a player who is still playing at the sub-table. If yes, then in process 268 it is determined whether the "ghost" player is playing in Linear or Parallel mode. If the "ghost" player is determined to be playing in Linear mode, then in process 270 the system 20 folds the cards for the "ghost" player at the main table. If the "ghost" player is determined to be playing in Parallel mode, then right-to-play logic is performed as shown in FIG. 3E and further described below. Control then returns to a process 272 in which a play clock is started. If in a process 274 it is determined that the "ghost" player did not bet in time at the main table, then in process 276 the system 20 folds the cards of the "Ghost" player in the main table hand. If the "ghost" player is determined to have bet in time, then in process 278 it is determined whether the hand at the sub-table is still in play. If not, then in process 280 the stakes at the main table are re-calculated for that player. In process 282 that player plays the hand at the main table in a normal manner. In a process 284 a new hand is dealt at the main table.

Referring now to FIG. 3E, it is determined whether a "ghost" player at the main table meets all conditions for playing in a hand at the main table. In a process 302 it is determined whether the player has enough money in his/her online account to cover any current sub-table exposure, i.e., amount of table stakes at risk of being lost by that player in the hand at the sub-table. If it determined that the player does not have enough money, then in a process 304 the system 20 folds the player's cards at the main table. If it is also determined in a process 306 that the player's seat is a "Blind" seat, then in process 308 the player receives a "Missed Blind" button. If it is determined that the player has enough money to cover exposure, and if it is also determined in process 310 that the player's seat is not a "Blind" seat, then the play clock is started in process 272 (shown in FIG. 3D.) If it is determined in the process 310 that the player's seat is a "Blind" seat, then it is determined whether the player has enough money in his/her online account to cover this blind. If not, then in process 314 the system 20 registers a blind overdraft to the player's online account and folds the player's cards at the main table. If the player does have enough money to cover the blind, then in process 316 the system 20 debits the player's online account by the amount of the blind and the play clock is started in process 272 (shown in FIG. 3D.) It should be noted generally that the order of various processes described above is exemplary and may vary in a given implementation. Additionally, unless otherwise stated in this disclosure, various processes may be performed substantially in parallel and not necessarily sequentially.

In various implementations of the disclosure, the integrity of a conventional game can be maintained, including but not limited to blinds, dealer buttons and "all-in" play. Strategic aspects of face-to-face poker play are retained to provide a canny player with the ability to compete at high levels of sophistication. Additionally, an action-seeking player is provided with the ability to see more hands per hour. For online poker operators, more hands-per-hour serves to increase both operator rake and player satisfaction.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A system for providing game play, the system comprising one or more processors and memory configured to:

designate a plurality of users as players at a table to play a plurality of hands at the table in an online game;

provide cards to the players for playing a first hand of the game; and when a jump point is reached in the first hand, provide to at least the players no longer playing the first hand:

cards for playing a second hand at the table; and continued online access to play of the first hand.

2. The system of claim 1, wherein a time interval during which the first hand is played is at least partially concurrent with a time interval during which the second hand is played.

3. The system of claim 1, wherein the one or more processors are further configured to provide cards for playing the second hand to at least one of the players still playing the first hand.

4. The system of claim 1, wherein the jump point is reached based on at least one of the following: a number of players still playing the first hand, and a set point of play in the first hand.

5. The system of claim 1, wherein the one or more processors are configured to include the plurality of users as players via the Internet.

6. The system of claim 1, wherein the one or more processors are configured to designate a sub-table of the table for play of the first hand or for play of the second hand.

7. The system of claim 1, wherein the online game includes Texas Hold 'Em.

8. A method of providing game play, the method performed by one or more processors using memory, the method comprising:

receiving inputs from a plurality of users by which the users choose to play an online game;

in response to the inputs, designating the users as players at an online table to play a plurality of hands at the table in the online game;

providing cards to the players for playing a first hand of the game; and when a jump point in the first hand is reached, providing cards for playing a second hand at the table to at least the players no longer playing the first hand; and continuing to provide online access by players of the second hand to play of the first hand.

9. The method of claim 8, wherein the jump point is reached when a plural number of players playing the first hand has diminished to a predetermined minimum.

10. The method of claim 8, wherein the jump point is reached when a predetermined number of players playing the first hand have committed to play in the first hand.

11. The method of claim 8, further comprising providing online access to all of the players to play of the first and second hands.

12. The method of claim 8, further comprising providing to the players playing in the first hand a choice as to whether to play in the second hand.

13. The method of claim 8, further comprising managing active seats in the second hand of players still playing in the first hand.

14. A system for providing game play, the system comprising one or more processors and memory configured to:

via a network, designate a plurality of users as players at a table to play a plurality of hands at the table in an online game;

provide cards to the players for playing a first hand of the game;

monitor at least a number of players still playing in the first hand;

based on the monitoring, determine whether a jump point is reached in the first hand; and based on the determining, provide to at least the players no longer playing the first hand:

cards for playing a second hand at the table; and continued online access to play of the first hand.

15. The system of claim 14, wherein a time interval during which the first hand is played is at least partially concurrent with a time interval during which the second hand is played.

16. The system of claim 14, wherein the one or more processors are further configured to provide cards for playing the second hand to at least one of the players still playing the first hand.

17. The system of claim 14, wherein the jump point is reached when a number of players playing the first hand has decreased to a predetermined plural number.

18. The system of claim 14, wherein the jump point is reached when a predetermined number of players playing the first hand have committed to play in the first hand.

19. The system of claim 14, wherein the one or more processors are configured to designate a sub-table of the table for play of the first hand or for play of the second hand.

20. The system of claim 14, wherein the one or more processors are configured to provide online access to all of the players to play of the first and second hands.

* * * * *